US007360289B2

(12) United States Patent
Fishburn

(10) Patent No.: US 7,360,289 B2
(45) Date of Patent: Apr. 22, 2008

(54) APPARATUS FOR MILLING A SURFACE

(76) Inventor: Douglas C. Fishburn, 15391 Steeles Avenue, Hornby, Ontario (CA) L0P 1E0

( * ) Notice: Subject to any disclaimer, the term of this patent is extended or adjusted under 35 U.S.C. 154(b) by 0 days.

(21) Appl. No.: 11/445,028

(22) Filed: Jun. 1, 2006

(65) Prior Publication Data

US 2007/0280801 A1 Dec. 6, 2007

(51) Int. Cl.
*B23C 1/20* (2006.01)

(52) U.S. Cl. ..... 29/27 B; 409/183; 409/207; 409/211; 409/212; 409/298; 409/337; 409/343; 409/345; 241/294; 83/869; 29/30

(58) Field of Classification Search ..... 409/183, 409/190, 191, 192, 199, 201, 202, 203, 204, 409/206, 207, 211, 212, 213, 288, 296, 297, 409/298, 301, 308, 311, 337, 338, 339, 342, 409/343, 345; 29/27 B, 30; 241/260.1, 241/294, 293, 295; 83/471.3, 472, 473, 477, 83/477.1, 481, 743, 745, 788, 795, 796, 797, 83/798, 863, 864, 869, 871, 875, 872, 873
See application file for complete search history.

(56) References Cited

U.S. PATENT DOCUMENTS 2,620,835 A 12/1952 Barnhart
2,735,455 A 2/1956 Forsberg
3,866,496 A 2/1975 Payne et al.
4,074,594 A * 2/1978 Dall et al. ..... 241/294
4,235,140 A 11/1980 Reece
4,245,535 A * 1/1981 Lockwood et al. ..... 83/798
4,275,853 A * 6/1981 Kreuz et al. ..... 241/294
4,583,891 A * 4/1986 Eschenfelder et al. ..... 409/212
4,584,918 A 4/1986 Stubbe et al.
4,739,939 A * 4/1988 Panning ..... 241/294
4,905,921 A * 3/1990 Faller ..... 241/294
4,947,910 A 8/1990 Reneau
5,033,174 A * 7/1991 Zieve ..... 29/34 B
5,046,391 A 9/1991 Lewis et al.
5,303,755 A 4/1994 Poling
5,404,779 A 4/1995 Break
5,509,338 A 4/1996 Ekker
5,567,094 A * 10/1996 Chung ..... 409/183
5,839,323 A * 11/1998 Line ..... 409/212
5,848,458 A * 12/1998 Bullen ..... 29/33 K
6,155,759 A 12/2000 Fishburn (Continued)

*Primary Examiner*—Dana Ross
(74) *Attorney, Agent, or Firm*—James W. Kayden; Thomas, Kayden, Horstemeyer & Risley

(57) ABSTRACT

The present invention provides an apparatus for use on a roof or the like which incorporates an insulation material. The invention allows workers to shave the insulating layer to smooth, remove high spots, or create slopes, valleys or sumps, in order to achieve positive slope for water drainage. As part of the invention, there is provided, an apparatus for milling the surface of a low slope substrate, comprising a milling device comprising a cylindrical tubular structure having an outer rotatable milling surface, said surface positionable adjacent said substrate and drivable in a rotary motion to mill the surface of the substrate; a milling device support upon which said milling device is mounted for movement in a milling direction; a mounting assembly for mounting said milling device to said support; said mounting assembly including means for adjusting the angle and depth of engagement of said milling surface to said substrate.

23 Claims, 9 Drawing Sheets

U.S. PATENT DOCUMENTS 6,223,413 B1 * 5/2001 Crocker et al. ..... 29/524.1
6,540,218 B2 * 4/2003 Tsukada et al. ..... 241/294
6,557,235 B1 * 5/2003 Katz et al. ..... 29/563

* cited by examiner

APPARATUS FOR MILLING A SURFACE

CROSS-REFERENCE TO RELATED APPLICATION

This application claims priority to a Canadian Application filed on Apr. 28, 2006, entitled Improved Apparatus for Milling a Surface, the application number of which has yet to be assigned, which is entirely incorporated herein by reference.

FIELD OF THE INVENTION

The invention is an apparatus for milling the surface of essentially low slope substrate. The invention is particularly useful for levelling a rigid insulation material applied to a roof during the process of roof construction.

Low slope roofs for buildings are typically comprised of a deck (or optionally a vapour barrier), a layer of insulation, or insulating fill, a waterproof membrane, and an exterior finish material. In order to avoid the ponding of water on the finished roof, the roof deck or insulation material is typically sloped to provide positive drainage. Often roofs are constructed without slope or include inadequate slope. Thus, positive slope often is not achieved.

SUMMARY OF THE INVENTION

The present invention provides an apparatus for use preferably on a roof or the like which incorporates an insulation material. The invention allows workers to shave the insulating layer to remove high spots, or create slopes, valleys or sumps, in order to achieve positive slope for water drainage. It should be understood that the invention may also be utilized on other substantially flat surfaces to smooth, remove high spots, create valleys, slopes and the like.

In accordance with an aspect of the invention, there is provided an apparatus for milling the surface of a low slope substrate, comprising: a milling device comprising a cylindrical tubular structure having an outer rotatable milling surface, positionable adjacent said substrate and which may be driven in a rotary motion to mill the surface of the substrate; a track positioned above said substrate along which the milling device is mounted in a position adjacent said substrate; a mounting assembly for mounting the milling device to the track, the mounting assembly including means for engaging the track and enabling movement of the assembly along the track in a milling direction, the milling device supported in rotatable engagement from the mounting assembly such that the milling surface engages the substrate for milling thereof, the mounting assembly including adjustment means for adjusting the angle and depth of the outer milling surface relative to the substrate to allow for variation in the depth and angle to be milled on the substrate.

In accordance with a further aspect of the invention there is provided, an apparatus for milling the surface of a low slope substrate, comprising a milling device comprising a cylindrical tubular structure having an outer rotatable milling surface, said surface positionable adjacent said substrate and drivable in a rotary motion to mill the surface of the substrate; a milling device support upon which said milling device is mounted for movement in a milling direction; a mounting assembly for mounting said milling device to said support; said mounting assembly including means for adjusting the angle and depth of engagement of said milling surface to said substrate.

Other objects, features and advantages of the present invention will be apparent from the following non-restrictive description of example embodiments of the invention, made with reference to the accompanying drawings.

DETAILED DESCRIPTION OF EXAMPLE EMBODIMENTS OF THE INVENTION

Figure 1:
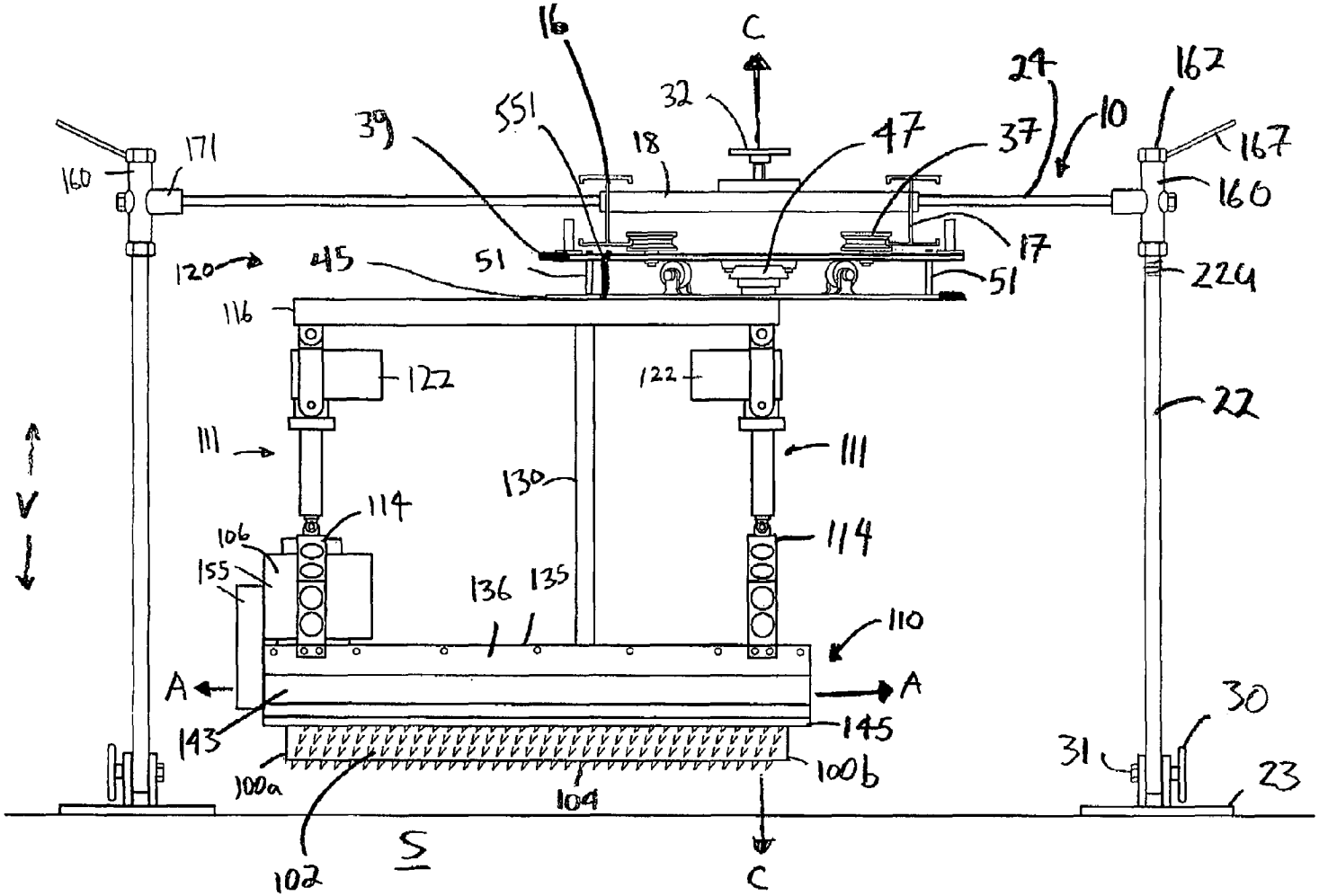
FIG. 1 is a front elevational view of an embodiment of the invention.

The invention will be described in relation to its use as an apparatus for leveling an insulating material installed on a roof or other structure or for the purpose of leveling or providing a slope. The apparatus can be used in new or retrofit construction type projects as to either level or slope a surface.

In the example embodiment shown in the figures, milling is accomplished by a rotatable cylindrical milling device 100 having an outer milling surface 102. In the embodiment shown, the outer milling surface comprises a plurality of rows of cutting teeth 104 on the outer circumferential surface thereof. Such teeth are preferably provided by a cutting chain 88, secured about the outer circumference, aligned in said plurality of rows. Shown schematically in FIGS. 1 and 2, teeth 104 in adjacent rows around the circumference of the milling device are aligned offset to each other and are aligned on a slight angle to the vertical plane V. The circumference and length of the device will vary depending on the desired depth of insulation to be removed.

As the device is rotated about its axis (defined by line A-A), driven by a motor 106, as will be discussed below, the device is brought into engagement with a substrate S at a selected slope angle and depth for milling a desired slope onto a roof or the like, and is moved along track 12 to define a milling run. The details of the track 12 and support structure 21 for the track are set out below. The milling device can be moved along the milling run by pulling, pushing, by a motorized gear or hydraulic cable device or any other known manner.

Figure 4:
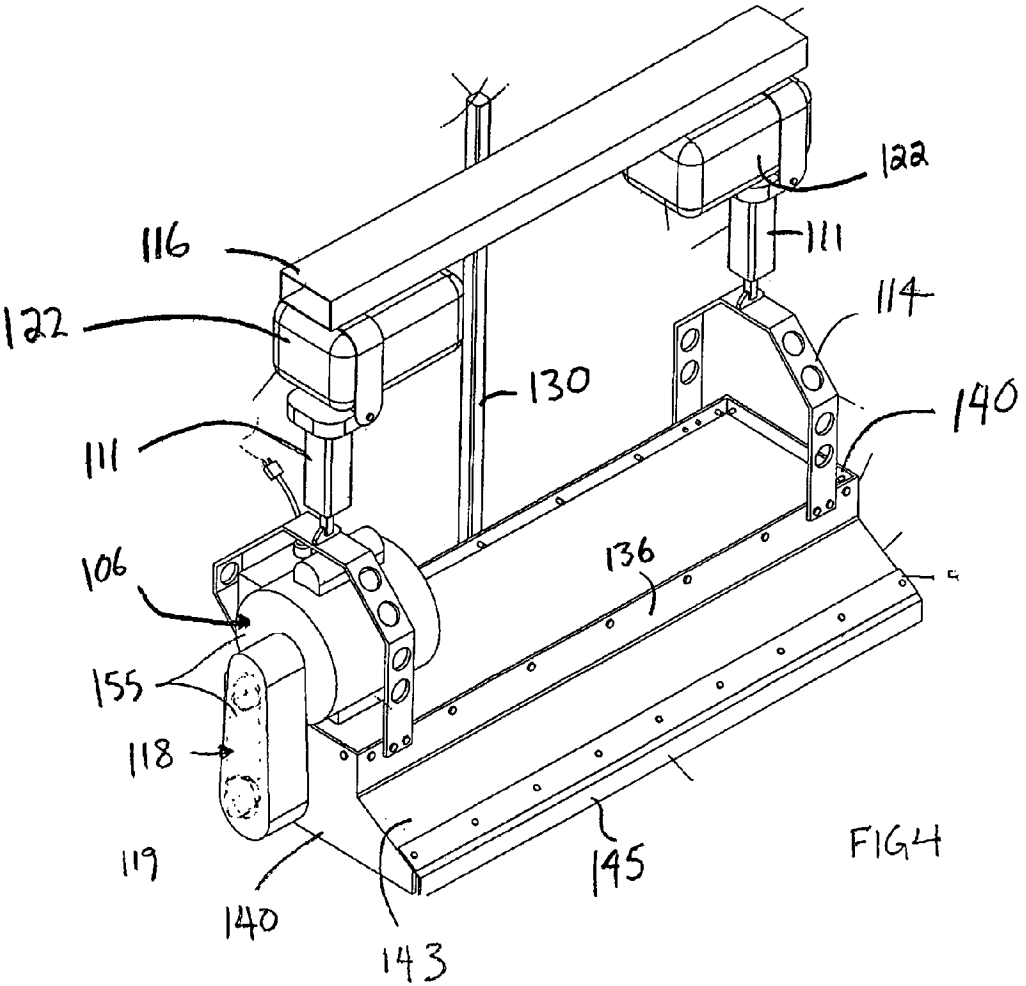
FIG. 4 is a perspective view of an embodiment of a mounting assembly in accordance with an aspect of the invention.
Figure 4A:
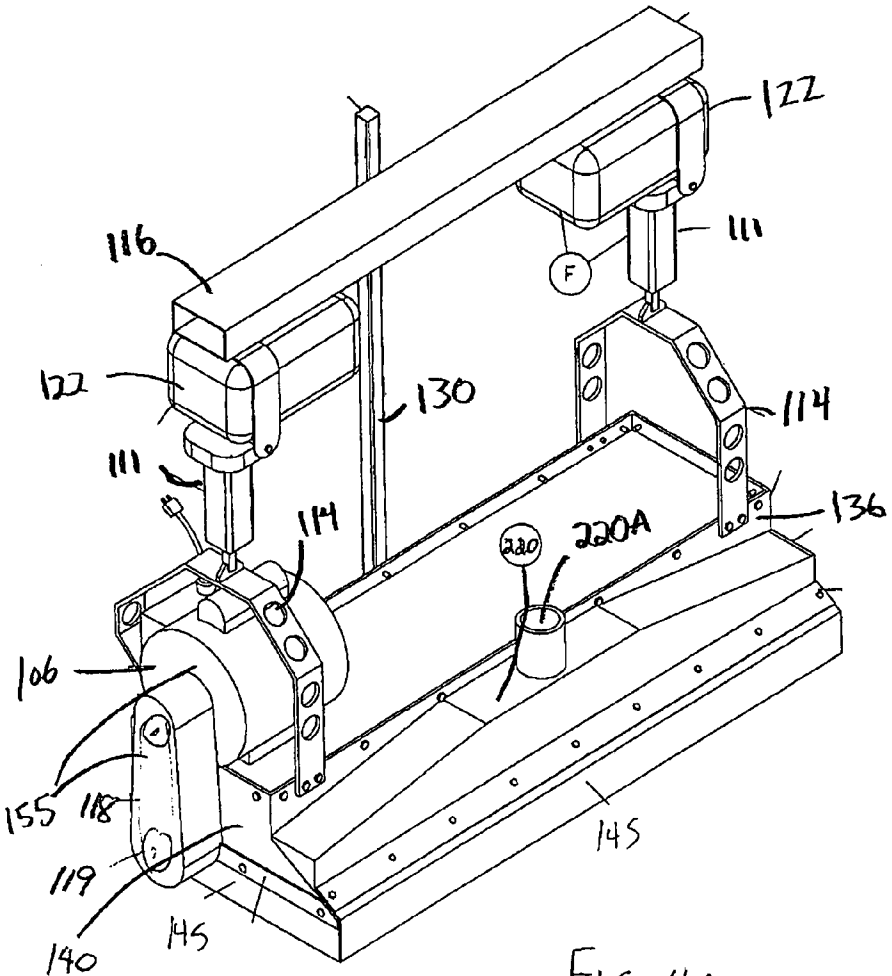
FIG. 4A is perspective view of an alternate embodiment of the milling device and lower frame of the mounting assembly illustrating a vacuum attachment thereto.
Figure 5A:
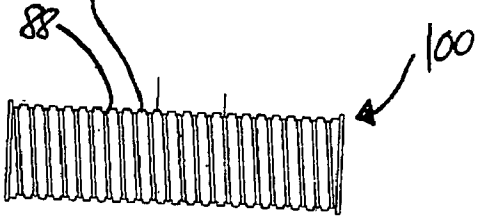
FIG. 5A is an illustration of a portion of an embodiment of the milling device illustrating saw chain wrapped around outer circumference thereof.
Figure 5:
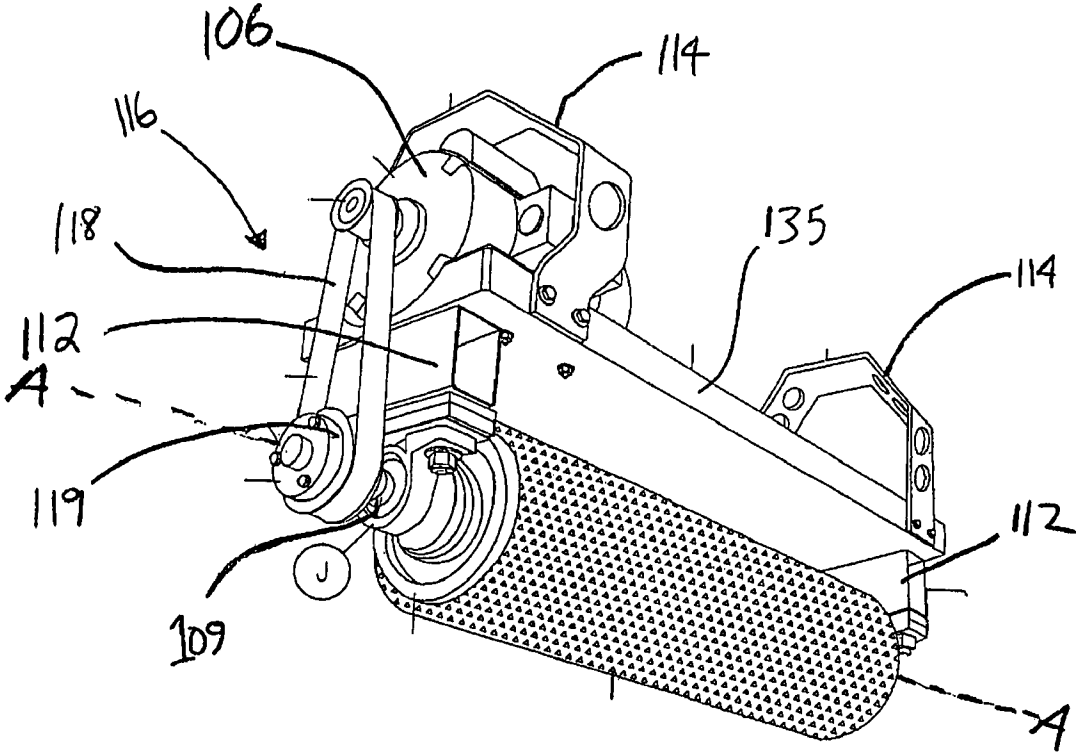
FIG. 5 is a bottom front elevation perspective view of an embodiment of the milling device mounted to the lower frame of the mounting assembly with outer portions of the lower frame not illustrate to best show features of the apparatus.

As best seen in FIG. 5 which is an illustration in isolation of an example milling device attached to the lower frame 110, an axle 109 extends through the rotational axis (A-A) of the milling device 100, extending outwardly from opposite sides 100*a*, 100*b* of the milling device. The milling device 100 is rotatably mounted to lower frame 110 as follows. The axle 109 protruding at each end is supported by an axle support 112, which is mounted on the top wall 135 of the lower frame at each end of the device 100. The lower frame 110 comprises top 135, rear 136, front 138 and side walls 140 bolted together, which surround an upper portion of the milling device, leaving a lower portion of the milling device to engage substrate S. A downwardly angled backward extension splash wall 143 extends rearwardly from the top 135 and rear wall 136 to prevent spraying of discharge of milled material upwardly at the front of the device 100. The extension wall 143 includes a downwardly oriented adjustable containment skirt 145, preferably comprised of rubber or metal, attached to the rear edge thereof which aids in the prevention of upward spraying of the milled material. It should be understood that the containment skirt may extend around rear 136, front 138 and side walls 140 if desired, such as is shown in FIG. 4A.

As can be seen in FIG. 4A, the lower frame may include a vacuum attachment 220 piece, formed as part of splash wall 143, having an inlet 220A communicating within the lower frame, adjacent the milling device. A vacuum hose may be attached to the inlet 220A which would allow for removal of milled material by vacuum means connected to said hose.

As can be seen in FIG. 5, the device 100 is rotated about axis A-A by drive means 116, which in the embodiment shown, is provided by a motor 106 mounted on the top wall 135 of lower frame 110, operatively connected to the milling device by means of a drive belt 118 which engages a drive end portion 119 of the axle, and rotates the device about its axis A-A. Drive belt and pulley for the motor are enclosed by protective covers 155.

The lower frame 100 is connected to an upper mounting assembly 101 by means of a pair of vertically adjustable legs 111 positioned at each end of the milling device. The legs are mounted to the lower frame each by a mounting bracket 114. In the example shown, each mounting bracket 114 is bolted to the front 136 and rear wall 138 of the frame. In the example shown, the legs 111 are mounted to an upper frame member 116 of the upper mounting assembly 120 which itself is attached to bottom plate 45 of the upper mounting assembly 120. The bottom plate 45 is mounted to an upper plate 39 in a manner described in detail below. To adjust the slope angle and depth of the milling device against substrate S, relative vertical alignment of the device may be achieved by electronically activated height adjustment of the vertical legs 111. The vertical legs 111 illustrated are of a retractable-extendable telescoping piston-type, however it should be understood that any suitable expandable and retractable leg form may be utilized. Electronic activation is provided by an electronic controller 122 which activates an extendable-retractable piston on each leg 111 to adjust the vertical height thereof. Control means is provided by an electronic control box system 122 connected to each leg by electronic wiring or the like, the user activation portion of which is preferably detachably mountable on the lower frame. Control may also be provided by wireless remote control. It should be understood that in accordance with a further aspect of the invention, the vertical adjustment of the legs may be achieved manually in any known manner, such as for example by hydraulic adjustable piston, or mechanically such as with a retractable telescoping post in a mating sleeve each having a plurality of mating holes into which a locking pin may be inserted to secure the post such that it extends from the sleeve at varying lengths.

Preferably, a vertical stabilizer bar 130 is mounted between upper mounting assembly (in the example mounted to upper frame member 116 of the upper mounting assembly 120) and the lower frame 110, preferably mounted to the front wall 138 at a central location between opposite ends 100*a* and 100*b* of the milling device 100. While one bar is shown, the device may include more than one bar. Other stabilizing devices could be utilized to connect the upper and lower frame if desired.

The stabilizer bar 130 is mounted to each of the upper frame member 116 and front wall 138 of lower frame by means of vertically oriented bracket 140, secured thereto, the bracket 140 sized to allow selective sliding engagement of the bar 130 relative to the upper frame member 116 and the lower frame 110.

Once slope angle and depth is adjusted by relative vertical adjustment of vertical legs 111, the stabilizer bar 130 is tightened into locking engagement in each bracket 140, preferably by quick locking means 142. In the example shown, quick locking means 142 is provided by a wing nut, which is threadably engaged in an opening 144 in the bracket and may be advanced until engaging the stabilizer bar 130 to securely fasten it in position within the bracket. Any suitable quick locking means may be provided, such as a through pin or bolt or the like. Once secured in place, the stabilizer bar 130 is designed to provide additional stability to the apparatus, necessitated by grinding forces from the milling device of this embodiment as it is pulled along the milling run.

In the embodiment shown, as the milling device operates along the milling run against a substrate S, and is moved along the track 12, forces from engagement of the milling device as it rotates against the substrate S, in part caused by the slight angle of the milling teeth 104 rows, tend to pull the device laterally to the direction of rotation of the device 100 as it is advanced along the guide track 12. In the illustration shown in FIG. 1, as the milling device 100 travels along the milling track 12 defining a milling run, the device tends to pull to the left (in the direction of the angle of the rows of teeth to the vertical). The stabilizer bar 130, once fastened securely into each bracket 140, by quick locking means 142, such as a wing nut or the like, acts to resist such lateral pulling forces.

Preferably, the operator of the machine moves the device along the track defining a milling run, for example by means of a cable (not shown) attached to the stabilizer bar 130. The milling device can be driven along the milling run by manual pulling, manual pushing, by a motorized gear, electronic, air or hydraulic motor or any other known manner.

Figure 3:
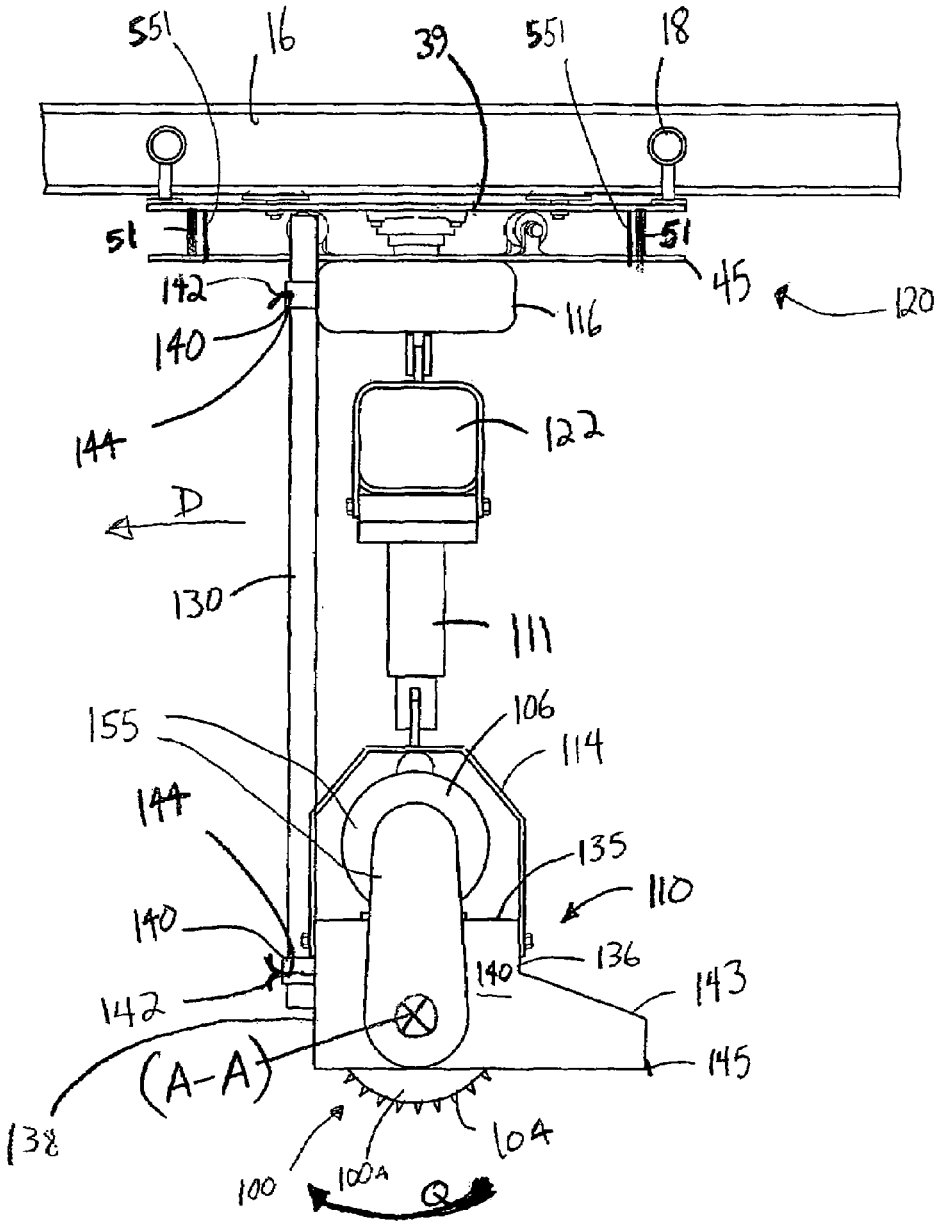
FIG. 3 is a side elevational view of the embodiment of FIG. 1 of the invention.

In the example shown, the milling device rotates in the direction opposite to the direction of travel of the milling device (i.e. in the direction of arrow Q in FIG. 3).

In an example of a milling run, the operator moves the device along track in a direction in a forward motion, with the device oriented in direction D. The depth and angle of the milling device may be adjusted as the device moves along the milling run by height adjustable vertical legs 120. As the device gets to end of run in direction A, the device is rotated about axis C-C, 180 degrees and is fixed in place by rod 551, then the device is moved back in the opposite direction to D, parallel thereto, creating a milled path adjacent and partially overlapping the initial run in direction D. By adjusting the depth and angle as the device is pulled along this adjacent run, the desired slope or trough or leveling may be formed. In the example embodiments shown, the milling device can mill from 1/16 inches to 4 inches or more in a single pass.

Further embodiments of aspects of the invention are described as follows: The apparatus 10 comprises a track, such as a ladder 12 along which the milling device 100 may move. The track 12 with two parallel rails 16 and 17 along which are spaced a plurality of rungs 18, which preferably are tubes extending through the rails 16 and 17. The track 12 total assembly is supported above the substrate roof insulation by means of a plurality of adjustable support structures 21, which comprise upright members 22, each being supported by a base 23, and a cross member 24 which is sized to extend through a tubular rung 18 of the track 12 and be slidably height adjustable along the upright members 22.

Figure 2:
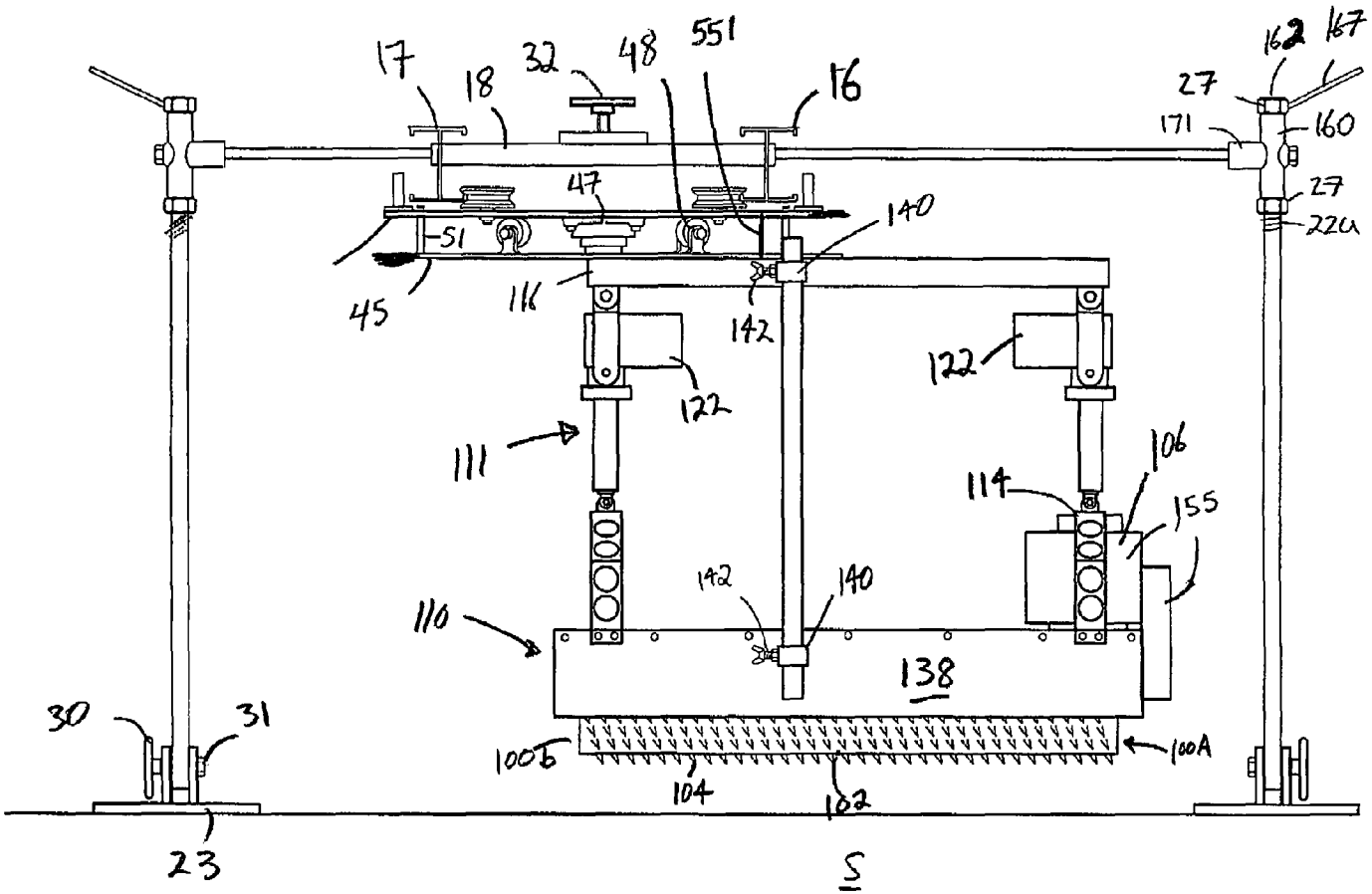
FIG. 2 is a rear elevational view of the embodiment of FIG. 1 of the invention.
Figure 8:
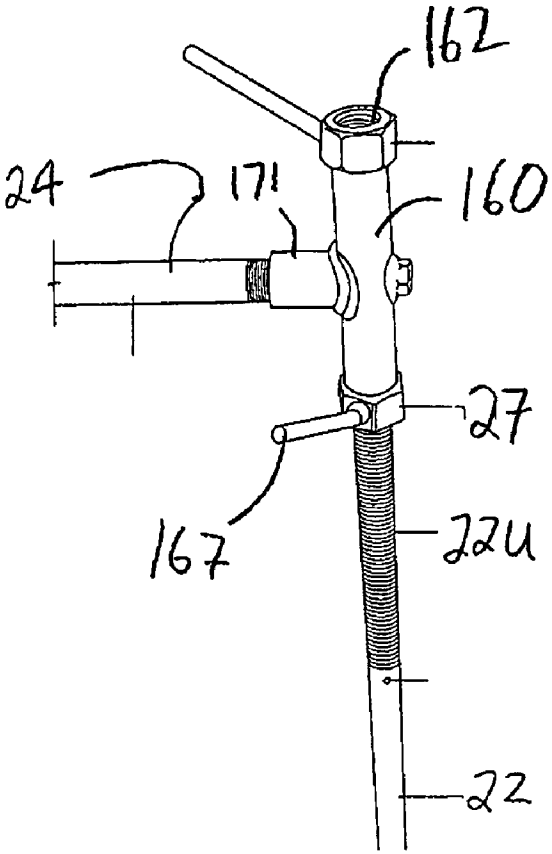
FIG. 8 is a detailed view of an embodiment of the means for attachment of the cross support members of the track to the upright members and means to adjust the support members relative to the plane of the track.

As best seen in FIGS. 1 and 8, an example apparatus for facilitating the assembly of the track (such as ladder 12) and cross member 24 and upright members 22 is shown. Cross member 24 is threadably engaged within a horizontally oriented sleeve 171 defining an opening in an attachment piece 160. Upper portions 22U of the upright members 22 are threadably engagable in a vertically oriented sleeve 162 in the attachment piece. Vertical sleeves 162 of attachment piece 160 are threaded along the upper portion of upright members 22U to allow vertical adjustment of the track. Each sleeve 162 is equipped with a locking means for securing the sleeve 162 in place along the upright member 22. A preferred locking means is at least one adjustable nut 27 positioned adjacent the sleeve 162 for selectively engaging the upright member 22 to secure the upright member in place in vertical sleeve by bringing the nut 27 into threaded engagement with the upper threaded portion 22U of the upright member and engagement against the sleeve 162. The nut is brought into threaded engagement with portion 22U by rotating same by means of handle 167. In addition to the height adjustment provided by vertically adjustable legs described above, the apparatus may also be adjusted by adjusting the angle of the track 12 itself by adjusting the relative height of the cross member 24 on the upright members 22.

In the embodiment shown, the upright member 22 is hinged to the base 23 and is securable at an angle to the base 23 by means of a bolt 30 and nut 31. This hinged relationship allows the base 23 to be oriented and provide support along the slope of a roof surface with the upright member 22 vertical.

Figure 1A:
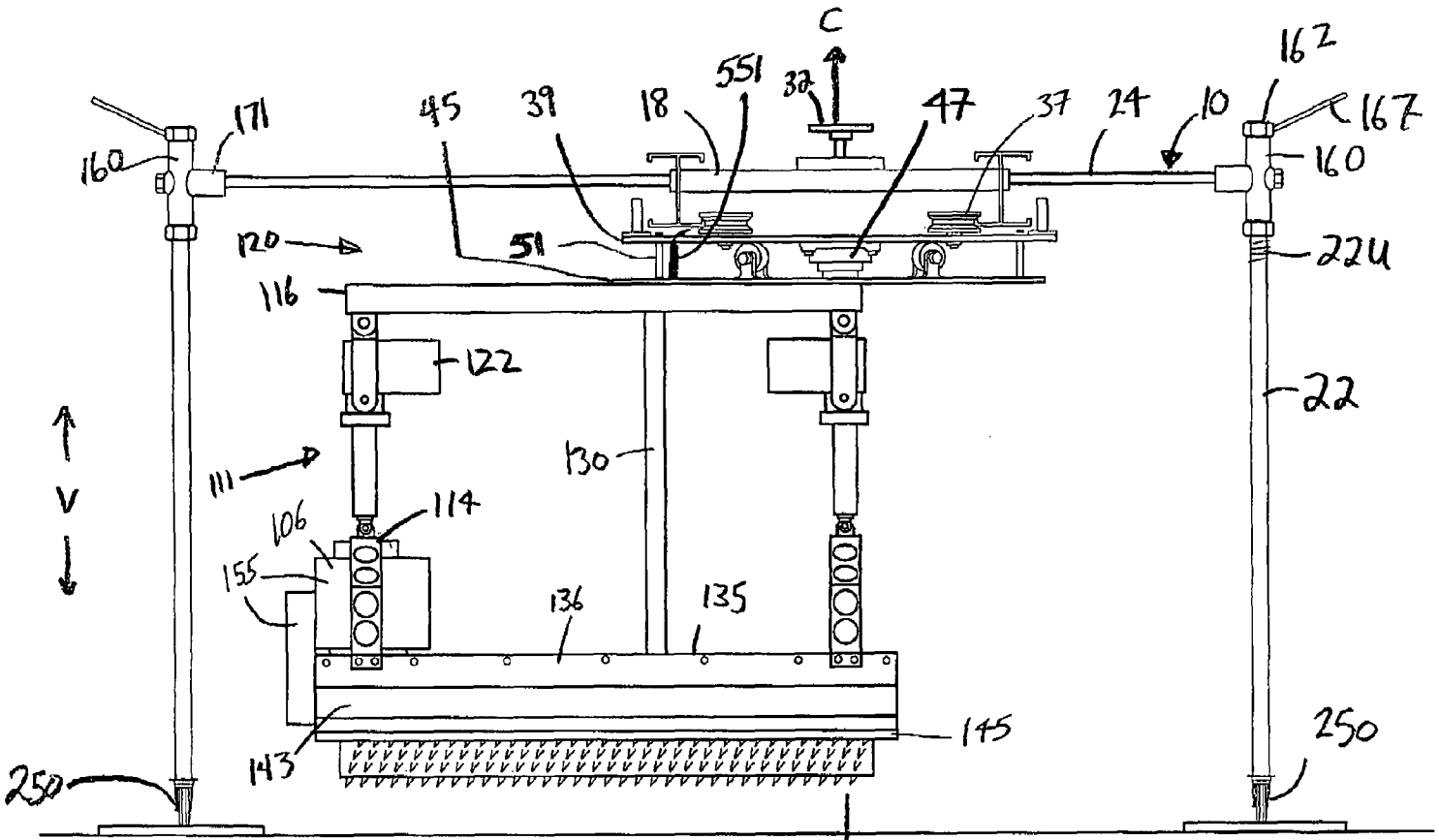
FIG. 1A is a front elevational view of an alternate embodiment of the invention illustrating supports for the track having wheels thereon.

In an alternate embodiment shown in FIG. 1A, the support members 22 are supported on wheels 250, which are selectively lockable in fixed positions to ensure that once a position is chosen the apparatus does not move. This allows the entire apparatus to be moved easily into desired positions on a construction site where site sloping or leveling is required to allow commencement of milling runs.

In a further alternate embodiment, not shown, but contemplated by an aspect of the invention, the milling device is carried by a mounting unit having a plurality of support wheels positioned outside of the milling device. Positioning of the wheels outside of the milling device allows the milling device to be rotated about vertical axis C. The milling device may be mounted to hang from the mounting unit in a similar manner as discussed above, to allow for adjustment of depth and angle of slope (i.e. for example with upper and lower frames connected by vertically adjustable legs). It could be mounted by other suitable means. However, the milling device does not move along a track in this embodiment, rather, it is fixed to the mounting unit and the mounting unit itself moves along the milling run itself, along its wheels. Preferably this mounting unit has 4 wheels positioned at outer corners of the unit. This allows easy transport and relocation of the device to various sites on a roof.

An example method for facilitating the assembly of the track 12 and support structures 21 is as follows. The cross members 24 are disassembled from the upright members 22, and a sleeve 171 is unscrewed from one end. The free ends of the cross members 24 are passed through rungs 18 and then reattached to the threaded sleeve 171 of attachment piece 160. The cross members 24 are spaced along the track 12 sufficiently close to one another to provide adequate support and stability to the apparatus as fully assembled. Typically, the cross members 24 are spaced 3 to 5 feet apart. Each rung 18 has a bolt 32 threaded through it for engaging and securing the cross member 24 to the rung 18. The track 12 having the cross members 24 extending through rungs 18 is then suspended above the substrate such as roof insulation by affixing each cross member 24 to a pair of upright members 22. The slope angle of the track 12 can be set at this stage of the assembly of the apparatus. However, it may also be achieved to allow such adjustment by means of adjustable vertical legs 111, in the manner discussed above.

Figure 6:
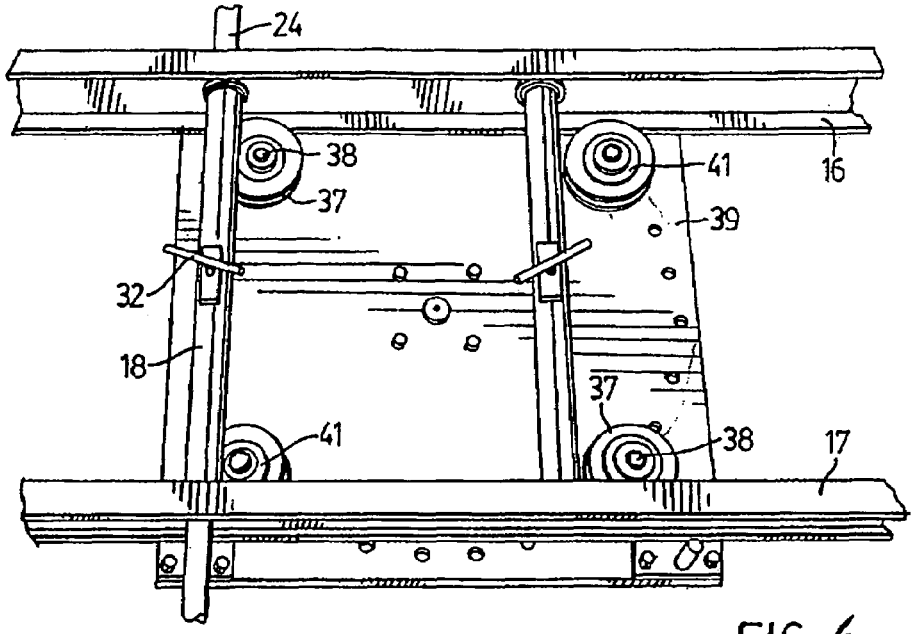
FIG. 6 is a top plan view of the track and top plate of the mounting assembly of the apparatus.
Figure 7:
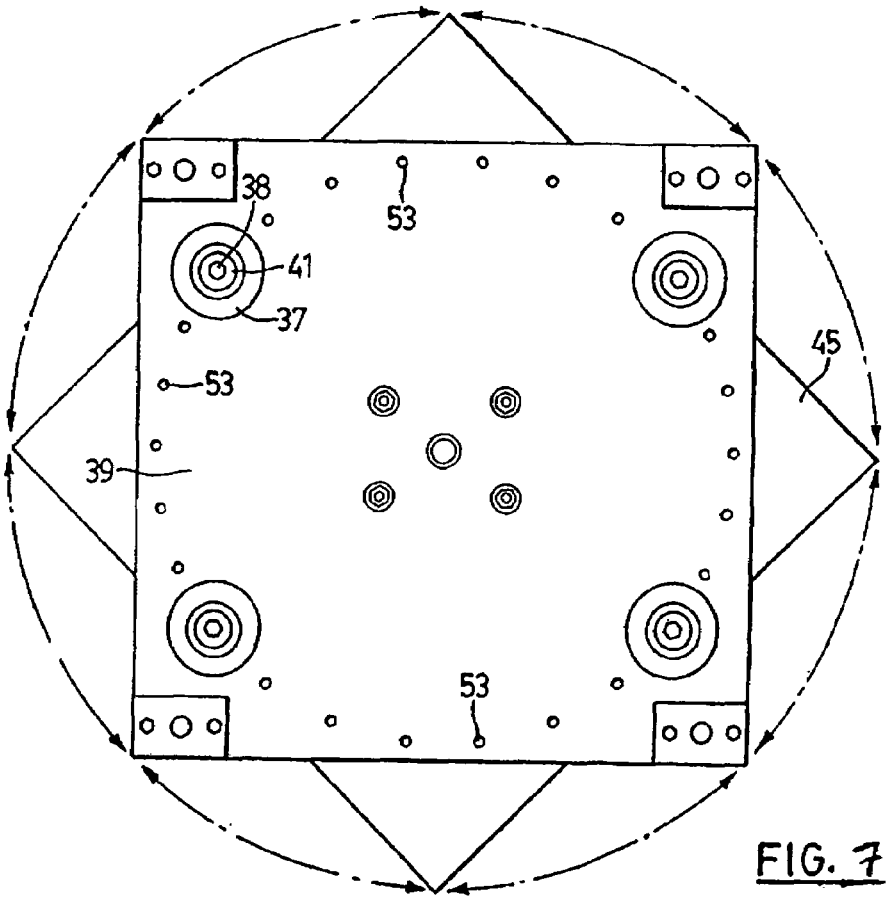
FIG. 7 is a plan view showing the rotatable connection of the top and bottom plates of the mounting assembly.

In the example shown, and as discussed above, the milling device 100 is suspended from the elevated track 12 by mounting assembly, which as discussed above comprises upper mounting assembly 120 attached to lower frame 110 by means of vertically adjustable legs 111, In the embodiment shown, the upper mounting assembly 120 comprises rail engaging rollers 37 each of which is mounted on a shaft 38 fixed in a top plate 39 (seen in FIGS. 6 and 7). Preferably, each roller 37 is provided with a roller bearing 41. In the embodiment shown, four rollers 37 are mounted in the top plate 39 with two rollers 37 engaging the rail 16 and two rollers 37 engaging the rail 17, but the skilled person will appreciate that other arrangements may be better suited for use in association with different milling devices. Also, a frame or similar structure may be used instead of the plate 39 in some circumstances. In the present embodiment, the plate 39 is preferred to facilitate the desired orientation of the milling device 100. Thus, the top plate 39 is attached to a bottom plate 45 by means of a shaft and roller bearing assembly 47 bolted to each plate 39 and 45. The roller bearing assembly 47 allows the bottom plate 45 to be rotated relative to the top plate 39. This rotational capability is facilitated by rollers 48 affixed to the bottom plate 45 and engaging the top plate 39. To provide stability and ensure proper alignment of the milling device a spacer 51 is positioned between the top and bottom plates, extending around the outer circumference of the plates. This spacer which could be a continuous circumferential piece 51 or a plurality of regularly spaced apart pieces extending around the circumference. The spacer is particularly important to provide proper alignment and stability and to prevent tipping of the device, given that in the preferred embodiment such as shown in FIG. 1, the milling device is offset from the vertical rotational axis of the device (Axis C in FIG. 1). It should be understood that milling device may or may not be offset from vertical axis C. The rotational orientation of the top plate 39 to the bottom plate 45 may be fixed by means of a spring loaded rod 551 attached to the bottom plate 45 and being extendable through any of a plurality of holes 53 formed through the top plate 39 in a circular array.

It is to be understood that while but several embodiments of the present invention have been herein shown and described, it will be understood that various changes in size and shape of parts may be made. It will be evident that these modifications, and others which may be obvious to persons of ordinary skill in the art, may be made without departing from the spirit or scope of the invention, which is accordingly limited only by the claims appended hereto, purposively construed.

What is claimed is:

1. An apparatus for milling the surface of a low slope substrate, comprising:

a milling device comprising a cylindrical tubular structure having an outer rotatable milling surface, positionable adjacent said substrate and which is drivable in a rotary motion to mill the surface of the substrate;

a track positioned above said substrate along which the milling device is mounted in a position adjacent said substrate;

a mounting assembly for mounting the milling device to the track, the mounting assembly including means for engaging the track and enabling movement of the assembly along the track in a milling direction, the milling device supported in rotatable engagement from the mounting assembly such that the milling surface engages the substrate for milling thereof, the mounting assembly including adjustment means for adjusting the angle and depth of the outer milling surface relative to the substrate to allow for variation in the depth and angle to be milled on the substrate; wherein the mounting assembly includes an upper mounting assembly which includes said means for engaging said track, said mounting assembly further including a lower frame upon which said milling device is rotatably mounted, said lower frame being connected to the upper mounting assembly by at least two vertically adjustable legs and wherein said vertically adjustable legs are extended and retracted by electronic control means operatively connected to each leg, thereby allowing adjustment of the depth and angle of the milling device against the substrate for milling.

2. The apparatus as recited in claim 1 wherein said outer milling surface comprises a plurality of rows of cutting teeth extending outwardly therefrom around the outer circumferential surface thereof.

3. The apparatus as recited in claim 1 wherein said outer rotatable milling surface includes a saw chain including a plurality of teeth, wrapped around said outer rotatable milling surface such that the teeth are oriented in rows.

4. The apparatus as recited in claim 3 wherein said teeth are aligned in rows positioned at an angle to direction of rotation of the cylindrical device.

5. The apparatus as recited in claim 1 wherein said upper mounting assembly includes a top plate having a plurality of rail engaging rollers for engaging the track.

6. The apparatus as recited in claim 5 wherein the upper mounting assembly comprises a bottom plate rotatably attached to the top plate, and the top and bottom plates being rotatably attached to one another by a shaft and roller bearing assembly affixed centrally to each plate.

7. The apparatus as recited in claim 6 wherein an upper frame member is attached to the bottom surface of said lower plate, and said vertically adjustable legs are mounted to said upper frame member.

8. The apparatus as claimed in claim 6, wherein a spacer is positioned between said top plate and bottom plate, positioned adjacent the outer circumference of said plates so as to stabilize the apparatus as bottom plate rotates relative to said top plate.

9. The apparatus as recited in claim 8 wherein the top plate has a plurality of holes through it in a circular array, and a spring loaded rod is attached to the bottom plate and is extendable through any of said holes in the top plate, thereby fixing a rotational orientation of the bottom plate relative to the top plate.

10. The apparatus as recited in claim 1 wherein said electronic control means is provided by an electronic control box operatively connected to each leg for vertical adjustment, said control box being detachably mountable on said mounting assembly.

11. The apparatus as 10 wherein said milling device is rotatably mounted to said lower frame at each end thereof by means by axle supports, which each carry a portion of the axle extending outwardly from said opposite ends of the milling device.

12. The apparatus as recited in claim 11 wherein the stabilizer bar is tightenable into locking engagement in each bracket by quick locking means.

13. The apparatus as recited in claim 1 wherein said milling device is driven in said rotary motion by means of a motor mounted on said mounting assembly operatively connected to the milling device by means of a drive belt which engages said milling device and rotates the device such that the outer milling surface mills the substrate.

14. The apparatus as recited in claim 1 wherein said milling device includes an axle extending through the rotational axis of the milling device, extending outwardly from opposite sides of the milling device and said drive means comprises a motor mounted on the lower frame, operatively connected to the milling device by means of a drive belt which engages a drive end of said axle, and rotates the device about said axis.

15. The apparatus as recited in claim 14, wherein said at least one vertical stabilizer bar is mounted to each of the upper mounting assembly and lower frames by means of vertically oriented bracket, each bracket allowing selective sliding engagement of the bar relative to the upper mounting assembly and the lower frame to allow for adjustment of length of vertically adjustable legs.

16. The apparatus as recited in claim 1 wherein at least one vertical stabilizer bar is mounted between the upper mounting assembly and the lower frame.

17. The apparatus as claimed in claim 1, wherein the means for engaging the track comprises four of said rail engaging rollers, each of which is mounted on a shaft fixed in the top plate of the mounting assembly, each of said rails being engaged by two said rail engaging rollers.

18. The apparatus as claimed in claim 1, further comprising a plurality of rollers affixed to the bottom plate and engaging the top plate.

19. The apparatus as recited in claim 1 wherein the track is supported above the substrate by a plurality of supports, each having adjustment means for orienting the track horizontally or at a desired angle to horizontal above the substrate.

20. An apparatus as recited in claim 1 wherein said track comprising a pair of parallel rails along which are spaced a plurality of rungs, said rails and said rungs forming a ladder structure.

21. Apparatus as recited in claim 1 wherein said lower frame comprises top, front, rear and side walls which surround an upper portion of the milling device, leaving a lower portion of the milling device exposed to engage said substrate, said walls oriented so as to prevent discharge of milled material except below the rear wall of the milling device.

22. Apparatus as recited in claim 1 wherein said lower frame further includes a vacuum attachment having a vacuum inlet positioned adjacent said milling device for gathering discharged milled material from the substrate.

23. An apparatus for milling the surface of a low slope substrate, comprising:

a milling device comprising a cylindrical tubular structure having an outer rotatable milling surface, said surface positionable adjacent said substrate and drivable in a rotary motion to mill the surface of the substrate;

a milling device support upon which said milling device is mounted for movement in a milling direction;

a mounting assembly for mounting said milling device to said support; said mounting assembly including means for adjusting the angle and depth of engagement of said milling surface to said substrate wherein the mounting assembly includes an upper mounting assembly which is mounted on said milling device support and a lower frame upon which said milling device is rotatably mounted, said lower frame being connected to the upper mounting assembly by at least two vertically adjustable legs and wherein said vertically adjustable legs are extended and retracted by electronic control means operatively connected to each leg, thereby allowing adjustment of the depth and angle of the milling device against the substrate for milling.

* * * * *